US005597061A

United States Patent [19]

Nishiumi et al.

[11] Patent Number: 5,597,061

[45] Date of Patent: Jan. 28, 1997

[54] COIN PROCESSING APPARATUS

[75] Inventors: Kenji Nishiumi, Hanno; Susuke Sumi, Tsurugashima, both of Japan

[73] Assignee: Kabushiki Kaisha Nippon Conlux, Japan

[21] Appl. No.: 354,750

[22] Filed: Dec. 8, 1994

Related U.S. Application Data

[63] Continuation of Ser. No. 876,167, Apr. 30, 1992, abandoned.

[30] Foreign Application Priority Data

Sep. 17, 1991 [JP] Japan ..... 3-236460

[51] Int. Cl.[6] ..... G07D 3/04; G07D 5/08

[52] U.S. Cl. ..... 194/348; 453/9

[58] Field of Search ..... 194/317, 318, 194/319, 348; 453/3, 4, 9, 14, 15

[56] References Cited

U.S. PATENT DOCUMENTS

| | | | |
|---|---|---|---|
| 3,791,503 | 2/1974 | Haeusset et al. . | |
| 3,844,297 | 10/1974 | Lautzenhiser | 453/9 |
| 3,906,965 | 9/1975 | Luyben et al. . | |
| 3,907,088 | 9/1975 | Burzen | 194/244 |
| 3,948,377 | 4/1976 | Hayashi et al. . | |
| 4,089,400 | 5/1978 | Gregory, Jr. . | |
| 4,095,607 | 6/1978 | Newton et al. . | |
| 4,106,610 | 8/1978 | Heiman | 194/317 |
| 4,228,811 | 10/1980 | Tanaka et al. | 194/317 X |
| 4,286,703 | 9/1981 | Schuller et al. . | |
| 4,367,760 | 1/1983 | Thomas et al. . | |
| 4,374,557 | 2/1983 | Sugimoto et al. . | |
| 4,706,202 | 11/1987 | Kobayashi et al. . | |
| 4,850,469 | 7/1989 | Hayashi et al. . | |

FOREIGN PATENT DOCUMENTS

| | | | |
|---|---|---|---|
| 48-95896 | 12/1973 | Japan . | |
| 1-311396 | 12/1989 | Japan . | |
| 2-76094 | 3/1990 | Japan . | |
| 2-76092 | 3/1990 | Japan . | |
| 2-76093 | 3/1990 | Japan | 194/348 |
| 2-76093 | 3/1990 | Japan | 194/348 |

*Primary Examiner*—F. J. Bartuska
*Attorney, Agent, or Firm*—Diller, Ramik & Wight, PC

[57] ABSTRACT

A coin processing apparatus comprises a coin selecting unit for determining whether put-in coins are genuine or not and denominations of the coins determined as genuine and guiding false coins to a predetermined coin path assigned for the false coin and the genuine coins to corresponding predetermined coin paths in accordance with their denominations, a coin accommodating unit for accommodating the genuine coins selected by the coin selecting unit for the respective denominations, and a coin payment unit for paying out coins having denominations corresponding to an amount of change from the coin accommodating unit, in which the coin selecting unit, the coin accommodating unit and the coin payment unit are inseparably provided as an integrated unit within a single housing. The coin selecting unit includes a liquid collector, a discharge path and a guide groove for rapidly discharging liquid poured into a coin slot to the outside of the coin processing apparatus.

5 Claims, 12 Drawing Sheets

COIN PROCESSING APPARATUS

This application is a continuation of application Ser. No. 07/876,167, filed Apr. 30, 1992, now abandoned.

BACKGROUND OF THE INVENTION

1. Field of the Invention

The present invention relates to coin processing apparatus used in vending machines, money exchangers, service devices, etc., and adapted to separate and accommodate put-in coins in accordance with denominations and pay out those separated and accommodated coins as change.

2. Description of the Related Art

Generally, vending machines, money exchangers, service devices, etc., include a coin processing apparatus for separating and accommodating put-in coins in accordance with denominations and paying out those coins as change.

This coin processing apparatus mainly composed of a coin selecting unit for determining whether put-in coins are genuine ones or not and denominations of the genuine coins, a coin accommodating unit for temporarily accommodating the genuine coins which are separated in accordance with their denominations and a coin payment unit for paying out coins accommodated in the coin accommodating unit as change. Each of these elements (coin selecting unit, coin accommodating unit and coin payment unit) are separately formed as independent parts and configured to be detachably mounted within the coin payment unit which constitutes a main body of the coin processing apparatus.

When a coin is put into the coin processing apparatus, the coin first enters into the coin selecting unit and checked whether a genuine one or not, and if it is a genuine one, it is classified in accordance with its denomination. The genuine coin is then accommodated in accordance with its denomination in a corresponding one of separate coin accommodating units disposed below the coin selecting unit. When denominations of change are determined, coins accommodated in the coin accommodating units are paid out for an amount corresponding to the sum of change from the coin payment unit disposed at the lowermost position.

The coin selecting unit has complicated coin paths which separate genuine coins from false coins and also separate the coins regarded as genuine in accordance with their denominations. Disposed in a part of the complicated coin paths are an electronic coin discriminating unit which includes, for example, an oscillating coil and a receiving coil, and selection units such as solenoids which distribute the coins to predetermined separate coin paths. While put-in coins are rolling in and passing through the coin path formed in the coin selecting unit, the coins are classified as genuine ones and false ones. The false coins are guided to a coin path assigned for the false coin, and the genuine coins are separated in accordance with their denominations and then guided into respective coin accommodating units provided for the respective denominations through predetermined coin paths assigned for the respective denominations.

According to the conventional coin processing apparatus, since the coin selecting unit, the coin accommodating unit and the coin payment unit are separately formed as independent elements and, when used, they are detachably attached to the coin payment unit which constitutes the main body of the coin processing apparatus, the structure of the coin processing apparatus is complicated and the number of parts are increased. Thus, the manufacturing cost of the whole coin processing apparatus becomes high.

According the coin processing apparatus as described above, complicated coin paths for selection of coins are formed in the coin selecting unit which constitutes a part of the coin processing apparatus. However, if liquid such as soft drink or cleaning detergent is poured into a coin slot of the coin processing apparatus, for example, the liquid will also flows into the coin selecting unit along the coin path where a coin rolls down. When adhesive liquid such as cleaning detergent flows through the coin path in the coin selecting unit, it will adhere to the selection units such as solenoids disposed in the coin path whereby the normal operation of such selection units is hindered and hence the selecting function is deteriorated.

When such adhesive liquid adhering to the selection units is dried, the operation of these selection units may be locked and the function of the coin processing apparatus itself may be stopped. Further the liquid may flow into a control circuit of the coin payment unit causing short-circuit of electric parts such as electronic circuits and a motor which results in a malfunction of the apparatus.

SUMMARY OF THE INVENTION

In view of such problems, the present invention is made to provide a coin processing apparatus having a simple structure with less parts.

In order to achieve such object, according to the present invention, a coin processing apparatus comprises a coin selecting unit for determining whether put-in coins are genuine or not and denominations of the coins determined as genuine, and guiding false coins to a predetermined coin path assigned for the false coin and the genuine coins to respective predetermined coin paths assigned for respective denominations in accordance with their denominations, a coin accommodating unit for accommodating the genuine coins selected by the coin selecting unit separately by their denominations, and a coin payment unit for paying out coins of denominations corresponding to an amount of change from the coin accommodating unit, in which the coin selecting unit, the coin accommodating unit and the coin payment unit are inseparably provided as an integrated unit within a single housing of the coin processing apparatus.

It is another object of the present invention to provide a coin processing apparatus which prevents liquid poured into the coin slot from adhering to selection units disposed in the coin selecting unit.

In order to achieve such object, a coin processing apparatus according to the present invention comprises in the coin selecting unit a liquid collector provided below the coin path directly communicating with the coin slot for collecting the liquid falling along the coin path, a discharge path communicating with the liquid collector for discharging the liquid collected in the collector to the outside of the coin selecting unit, and a guide groove provided on the inner wall of the coin path directly communicating with the coin slot, for guiding the liquid falling along the coin path to the discharge path.

Other objects and effects of the present invention will be easily confirmed by the following detailed description and accompanying drawings.

DESCRIPTION OF THE PREFERRED EMBODIMENT

One embodiment of a coin processing apparatus according to the present invention will be described in detail below.

Figure 1:
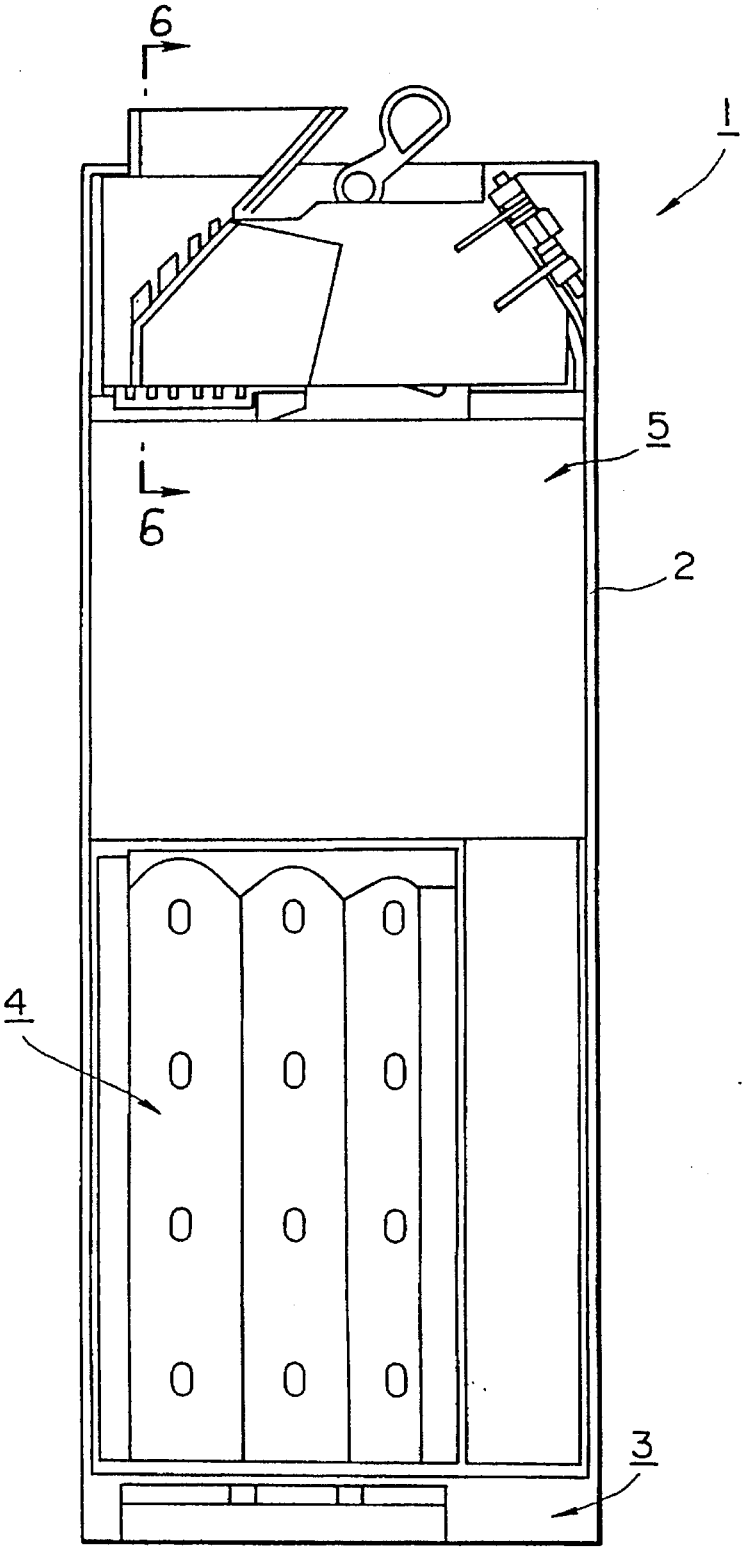
FIG. 1 is a schematic front view of a coin processing apparatus according to the present invention.
Figure 2:
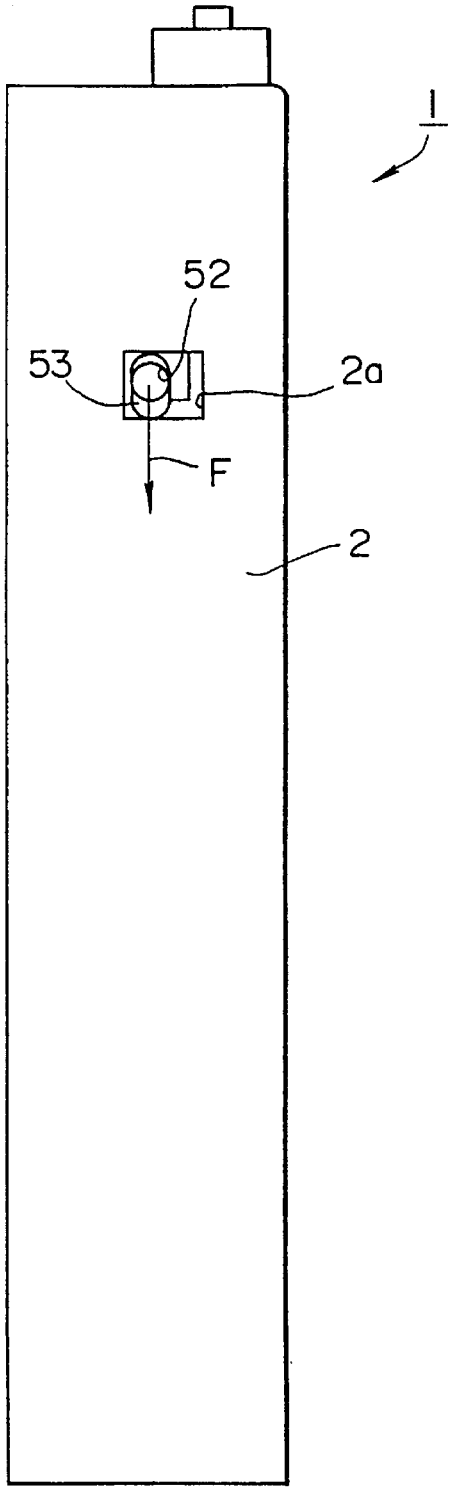
FIG. 2 is a left side view of the coin processing apparatus of FIG. 1.

FIGS. 1 and 2 are a front and a left side views, respectively, of a coin processing apparatus 1 according to the present invention.

The coin processing apparatus 1 comprises a housing 2 which constitutes a main body of the coin processing apparatus, and a coin payment unit 3, a coin accommodating unit 4 and a coin selecting unit 5 which are inseparably provided as an integrated unit within the housing 2.

The coin payment unit 3 is disposed at the lowest position in the housing 2. The coin accommodating unit 4 includes a plurality of coin tubes disposed above the coin payment unit 3. The coin selecting unit 5 is disposed at the highest position in the housing 2.

Figure 3:
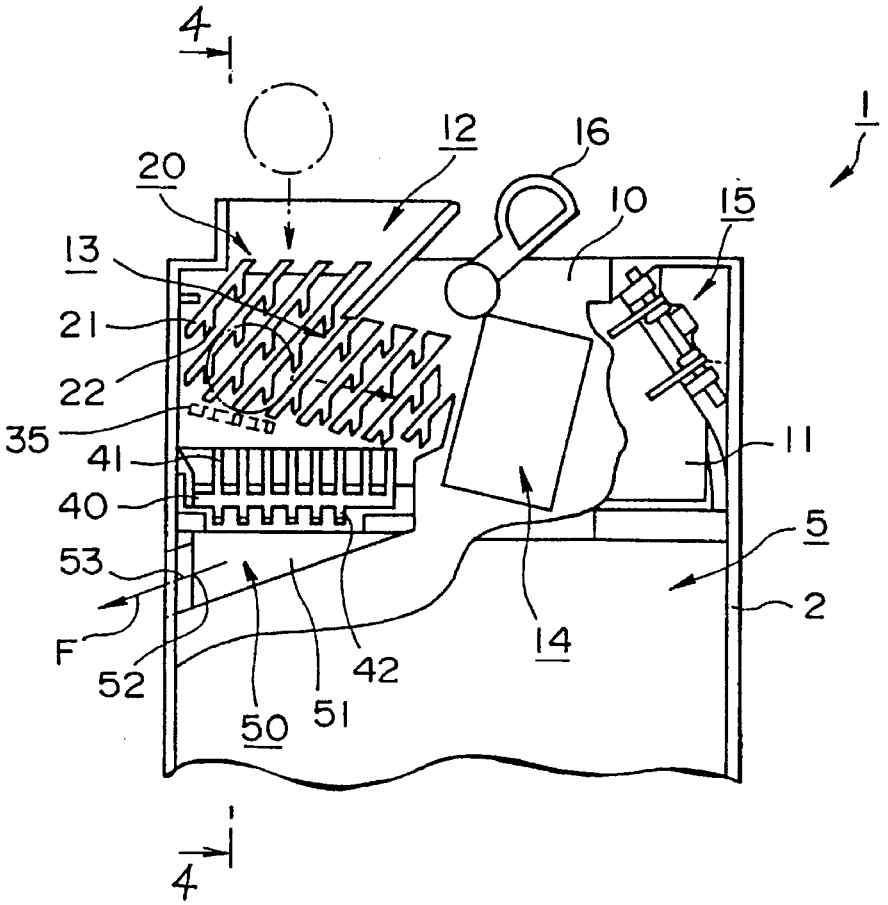
FIG. 3 is a cutaway fragmentary view of the essential portion of a coin selecting unit.

The coin selecting unit 5 has a coin slot 12 defined by an upper end portion of a main plate 10 and a gate plate 11, as shown in FIG. 3 which is a cutaway enlarged view of the essential portion of the coin selecting unit 5. A first tilted coin path 13 is formed substantially under the coin slot 12 such that it communicates with a lower end of the coin slot 12 and rolls a coin (shown by a dot-dashed line) put therein from the coin slot 12 toward rightward in FIG. 3. A coil sensor 14 is disposed in the middle of the first coin path 13 which determines whether the put-in coin is a genuine one or not and determines the denomination of the coin regarded as a genuine one during passage of the coin. The coil sensor 14 includes an oscillating coil and a receiving coil (both are not shown) disposed opposite to each other with a predetermined spacing therebetween for allowing the put-in coin to pass through the spacing.

Figure 4:
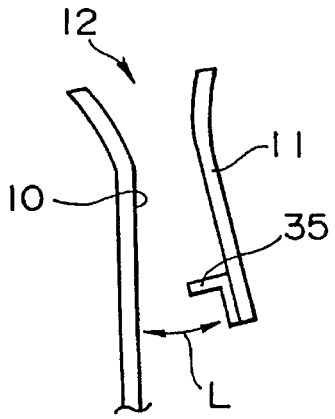
FIG. 4 is a schematic cross-sectional view taken along the lines 4—4 of FIG. 3.

A pivot 15 of the gate plate 11 which opens and closes the coin slot 12 is provided tilted at an upper right corner thereof. Thus, when a gate lever 16 is turned to open the coin slot 12, the gate plate 11 is tilted to open to thereby ensure a large opening/closing stroke L of a lower end of the gate plate 11 so as to quickly discharge a coin clogged in the coin slot 12, as shown in FIG. 4 which is a conceptual view taken along the lines 4—4 of FIG. 3.

Guide grooves 20 are formed on the main plate 10 which constitutes one of the members defining the coin slot 12 shown in FIG. 3 for guiding the liquid poured into the coin slot 12.

The guide grooves 20 are provided at predetermined pitches on the main plate 10 disposed along the inner wall surface of the coin slot 12 and includes a plurality of tilted fins (convexities) 21 and a plurality of dams 22 vertically and downwardly extending at predetermined pitches from the lower surfaces of the respective fins 21.

Figure 5:
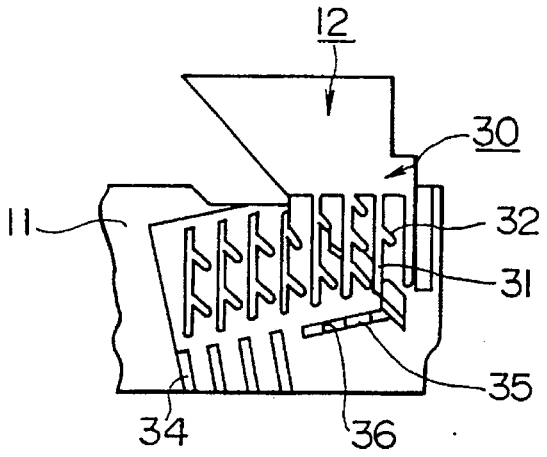
FIG. 5 is a fragmentary cutaway view of a gate plate.

As shown in FIG. 5 which is a back view of the essential portion of the gate plate 11 which constitutes the other of the members defining the coin slot 12, guide grooves 30 are formed on the gate plate 11 so that the guide grooves 20 and the guide grooves 30 face with each other (FIG. 3). The guide grooves 30 are configured by a plurality of fins (convexities) 31 formed vertically and downwardly along the coin slot 12 and a plurality of tilted dams 32 formed between adjacent fins. As shown in FIG. 5, a plurality of fins (convexities) 34 are formed on the lower portion of the gate plate 11 to guide the liquid falling from the guide groove 30 in the left portion of FIG. 5 toward the right portion of FIG. 5. The reference numeral 35 in FIG. 5 denotes a gate rail fixed to the gate plate 11 and constituting a part of the first coin math 13 and having a plurality of slits 36 for guiding the falling liquid downwardly.

As shown in FIG. 3, a shoot 40 is formed at a lower end of the main plate 10 and has a plurality of elongated holes 41. A plurality of protrusions 42 vertically and downwardly extending from a lower end of the shoot 40 are provided. The plurality of protrusions 42 extend into a liquid collector 50 disposed below the coin slot 12.

Figure 6:
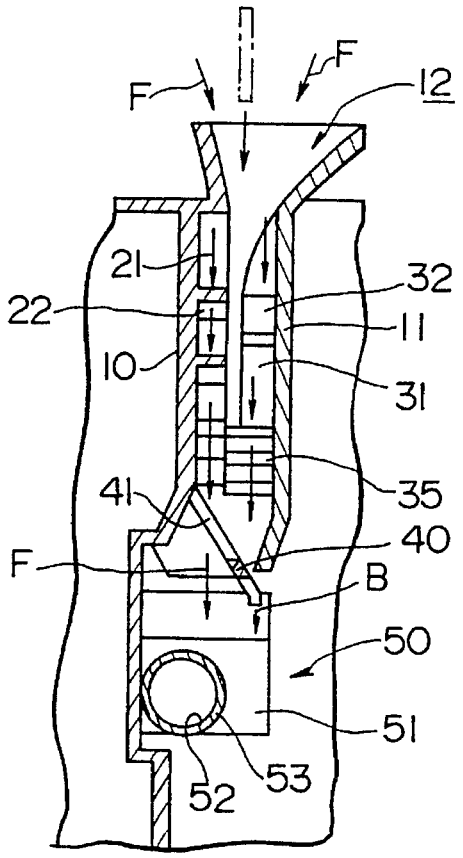
FIG. 6 is a schematic cross-sectional view taken along the lines 6—6 of FIG. 1.

As shown in FIG. 6 which is an enlarged cross-sectional view taken along the line 6—6 of FIG. 1, the liquid collector 50 includes a box 51 having an open upper end. A hole 52 for discharging the collected liquid therethrough and a discharge path formed by a pipe 53 which communicates with the hole 52 are provided on the left side of the collector 50 (FIG. 3). As shown in FIG. 2, the pipe 53 extends through a hole 2*a* formed on one side of the housing 2 to the outside of the housing 2.

Discharge of the liquid using the liquid guide grooves 20 and 30 formed around the coin slot 12 will be described.

As shown in FIG. 6, when liquid F such as cleaning detergent is poured into the coin slot 12, the liquid F is guided between the plurality of fins 21 formed on the main plate 10 and the plurality of fins 31 formed on the gate plate 11 and falls downward from the coin slot 12. At that time, the flow of the liquid F is intercepted by the respective dams 22 and 32 formed on the main plate 10 and the gate plate 11 while falling whereby a rapid fall of the liquid is prevented.

The liquid F guided through the path between the fins 21 formed on the main plate 10 and the fins 31 formed on the gate plate 11 is then guided to the elongated hole 41 in the shoot 40 and its vicinity and collected in the box 51 constituting the liquid collector 50. Since the liquid F falls into the box 51 while being intercepted by the dams 22 and 32, as mentioned above, a large amount of the liquid F does not rapidly fall into the box 51 and thus the collected liquid does not overflow from the box 51 and does not adhere to the vicinity of the box 51. The liquid F falling into the box 51 is rapidly discharged to the outside of the housing 2 through the pipe 53 communicating with the hole 52 from the left side of the housing 2 shown in FIG. 2, as shown by an arrow F in FIG. 3.

Thus, according to the coin selecting unit 5 mentioned above, even if adhesive liquid such as cleaning detergent is poured into the coin slot 12, the liquid is discharged rapidly from the lower end of the coin slot 12 to the outside of the housing 2 of the coin processing apparatus. Therefore, no liquid adheres to various selection units disposed downstream of the coin selecting unit 5 and thus the function of the selection units is not deteriorated.

Figure 7:
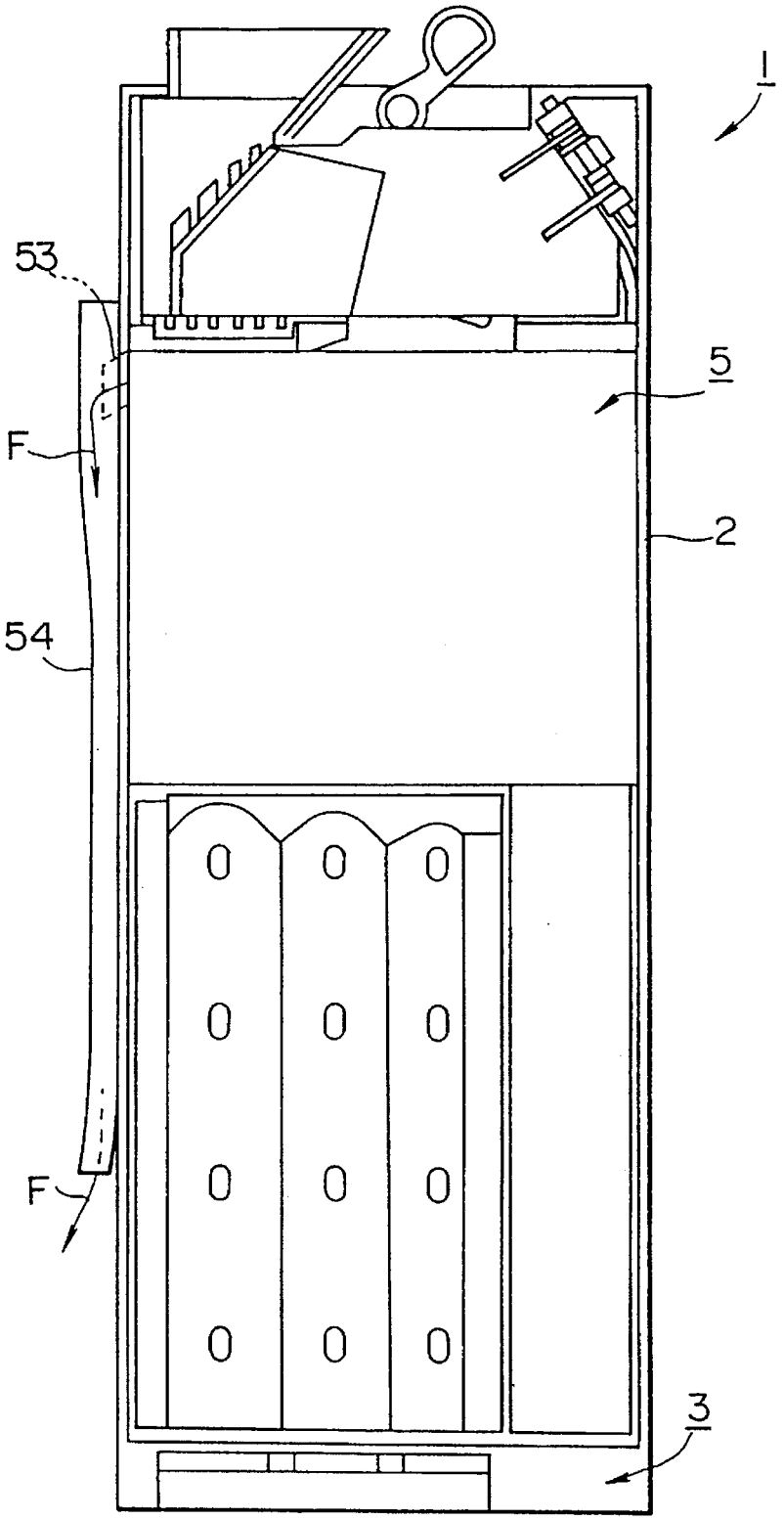
FIG. 7 is a front view of the coin processing apparatus according to the present invention provided with a liquid discharge tube attached to the side of the coin processing apparatus.
Figure 8:
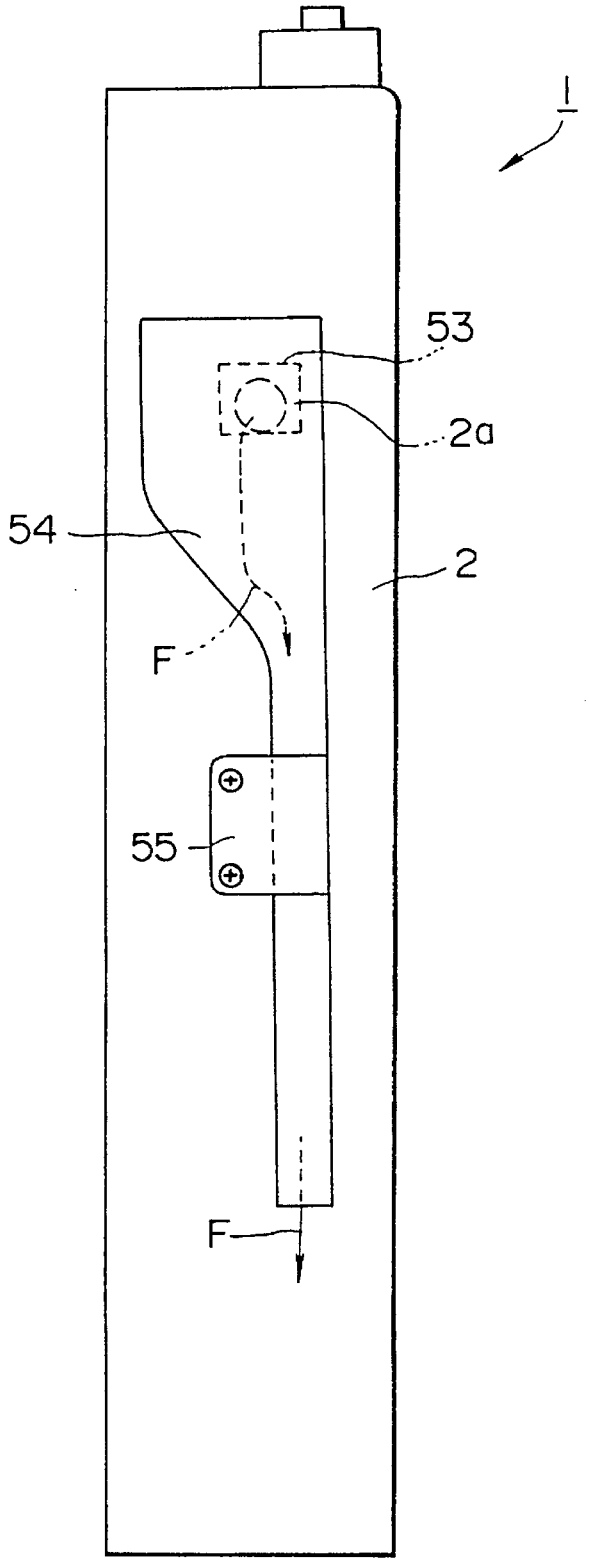
FIG. 8 is a left side view of the coin processing apparatus of FIG. 7.

By disposing on the left side of the housing 2 a tube 54 which communicates with the pipe 53 of the liquid collector 50 as shown in FIGS. 7 and 8 which show the front and left side of the coin processing apparatus where the same reference numerals are used to denote the same elements as that in FIG. 1, the liquid F discharged through the pipe 53 from the liquid collector 50 is rapidly discharged through the tube 54 to the outside of a device, such as an automatic vending machine, which incorporates the coin processing apparatus 1. A reference numeral 55 in FIG. 8 denotes a fastener which secures the tube 54 to the side of the housing 2.

The coin selecting function of the coin selecting unit 5 mentioned above and its structure will be described below in more detail.

Figure 9:
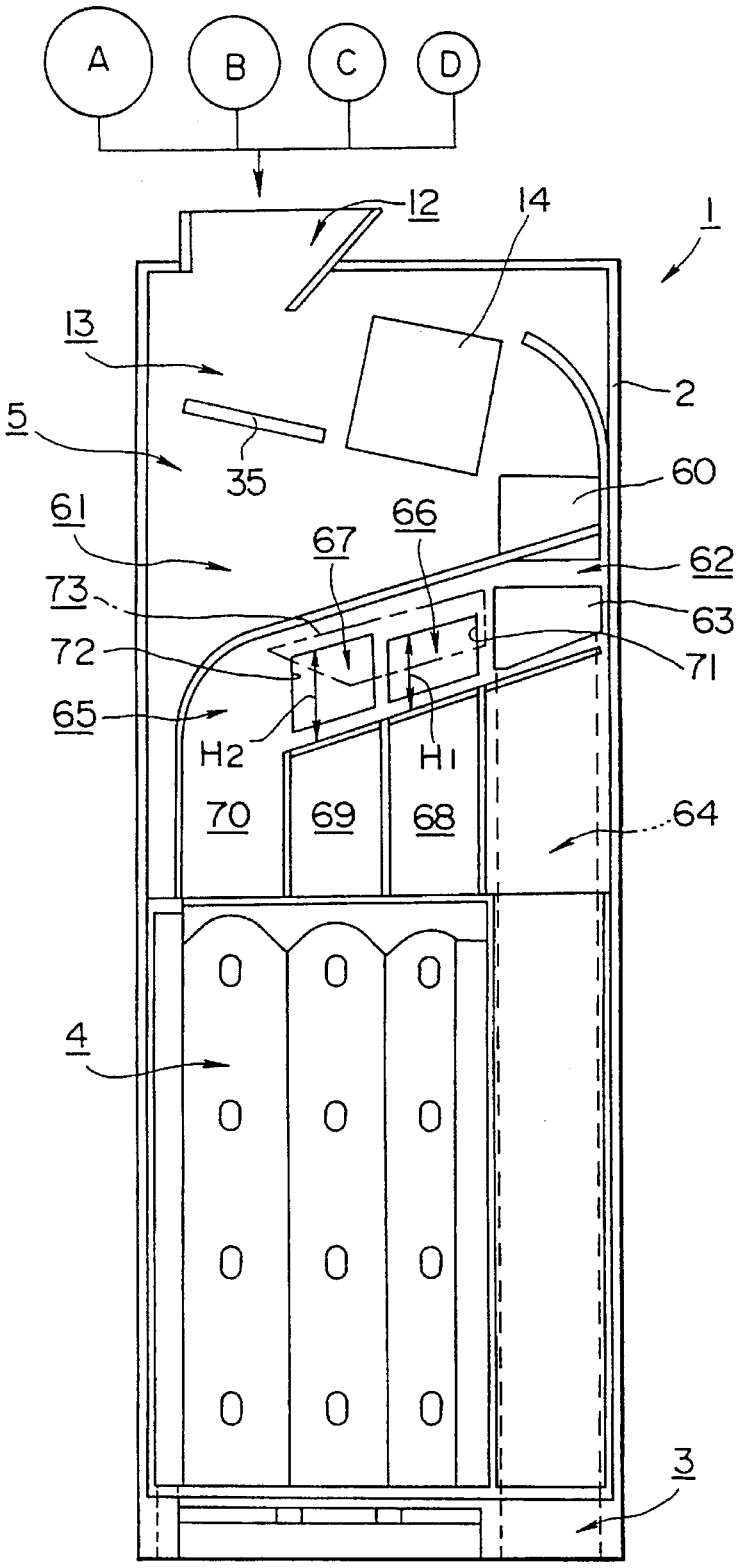
FIG. 9 is a conceptual view of a coin processing apparatus which illustrates the coin selective operation of the coin selecting unit.

FIG. 9 is a conceptual view of the coin processing apparatus 1 used for simply explaining the coin selecting function of the coin selecting unit 5. The same numerals in FIG. 9 and FIGS. 1 to 6 denote the same elements. In FIG. 9, illustration of the liquid discharge mechanism, such as, the liquid guide grooves 20 and 30 shown in FIGS. 3 to 6 is omitted.

The coin selecting unit 5 selects four kinds of coins (genuine coins) A, B, C and D having different diameters and false coins. The diameter of the coin A is set to be maximum and the diameters of the coins B, C and D are set to be smaller in this order than the diameter of the coin A, that is, the diameters are set to be A>B>C>D.

The first coin path 13 is formed tilted rightward in FIG. 9 immediately below the coin slot 12 in the coin selecting unit 5, and the coil sensor 14 is provided halfway through the first coin path 13 so as to determine whether the coin is a genuine coin, and the denomination of the coin if the coin is a genuine one.

A first lever 60 is provided at the terminal end of the first coin path 13 to separate genuine coins from false coins and to guide them to corresponding separate coin paths. The first lever 60 is a lever of the type which is opened and closed at the upper end in a direction perpendicular to the plane of FIG. 9 about a lower end thereof. By the first lever 60, the first coin path 13 is caused to communicate at the terminal end with a second coin path 61 which guides only false coins or with a third coin path 62 which guides only genuine coins. The first lever 60 is usually closed at the upper end and, when operated, opens at the upper end for a predetermined rotational angle.

Provided halfway through the third coin path 62 is a second lever 63 by which a group of genuine coins A, B, C and D guided to the third coin path 62 is separated into the coin A having the maximum diameter and a group of coins B, C and D having diameters smaller than the diameter of the coin A.

The third coin path 62 is caused to communicate by the second lever 63 with a fourth coin path 64 formed on the back side of the housing 2 and which guides the coin A only, and a fifth coin path 65 formed tilted left in FIG. 9 and which guides the coins B, C and D other than the coin A. The second lever 63 is also of the type which is opened and closed at the upper end in a direction perpendicular to the Diane of FIG. 9 about the lower end as same with the first lever 60. The second lever 63 is usually opened at its upper end for a predetermined rotational angle and, when operated, closes at the upper end.

Disposed in the fifth coin path 65 are first and second rail-type coin selection means 66 and 67 which select rolling coins B, C and D in accordance with their diameters. The fifth coin path 65 is caused to communicate at a middle point by the first rail-type coin selection means 66 with the sixth coin path 68 while the downstream of the fifth coin path 65 is caused to communicate by the second rail-type coin selection means 67 with seventh or eighth coin paths 69 or 70.

The first and second rail-type coin selection means 66 and 67 include rectangular windows 71 and 72, respectively, provided on the side of the fifth coin path 65 and a convexity 73 (shown by dot-dashed line) which pushes down coins rolling in the fifth coin path 65 toward the windows 71 and 72. The height H1 of the window 71 constituting a part of the first rail-type coin selection means 66 is slightly larger than the diameter of the coin D having the smallest diameter among the coins B, C and D and smaller than the diameter of the coin C which is the next smallest. The height H2 of the window 72 constituting a part of the second rail-type coin selection means 67 is slightly larger than the diameter of the coin C and smaller than the diameter of the coin B.

Therefore, when the coins B, C and D which have decreasing diameters in this order are guided into the fifth coin path 65, the coins B, C and D are pushed down by the convexity 73 against the windows 71 and 72 while rolling. At this time, since the diameters of the coins B and C are larger than the height H1 of the window 71, those coins pass by the window 71 while since the diameter of the coin D is smaller than the height H1, the coin D is tilted into the window 71 while changing its posture and falls into the sixth coin path 68 formed below the window 71. When the coins B and C are passing by the window 72, the coin B passes by the window 72 because the diameter of the coin B is larger than the height H2 of the window 72 while since the diameter of the coin C is smaller than the height H2 of the window 72, the coin C is tilted into the window 72 while changing its posture and falls into the seventh coin path 69 formed below the window 72. The coin B having the maximum diameter among the coins B, C and D guided into the fifth coin path 65 passes by the windows 71 and 72 and falls into the eighth coin path 70 communicating with the lower end of the fifth coin path 65.

The selective operation of the coin selecting unit 5 will now be described in more detail.

Figure 10:
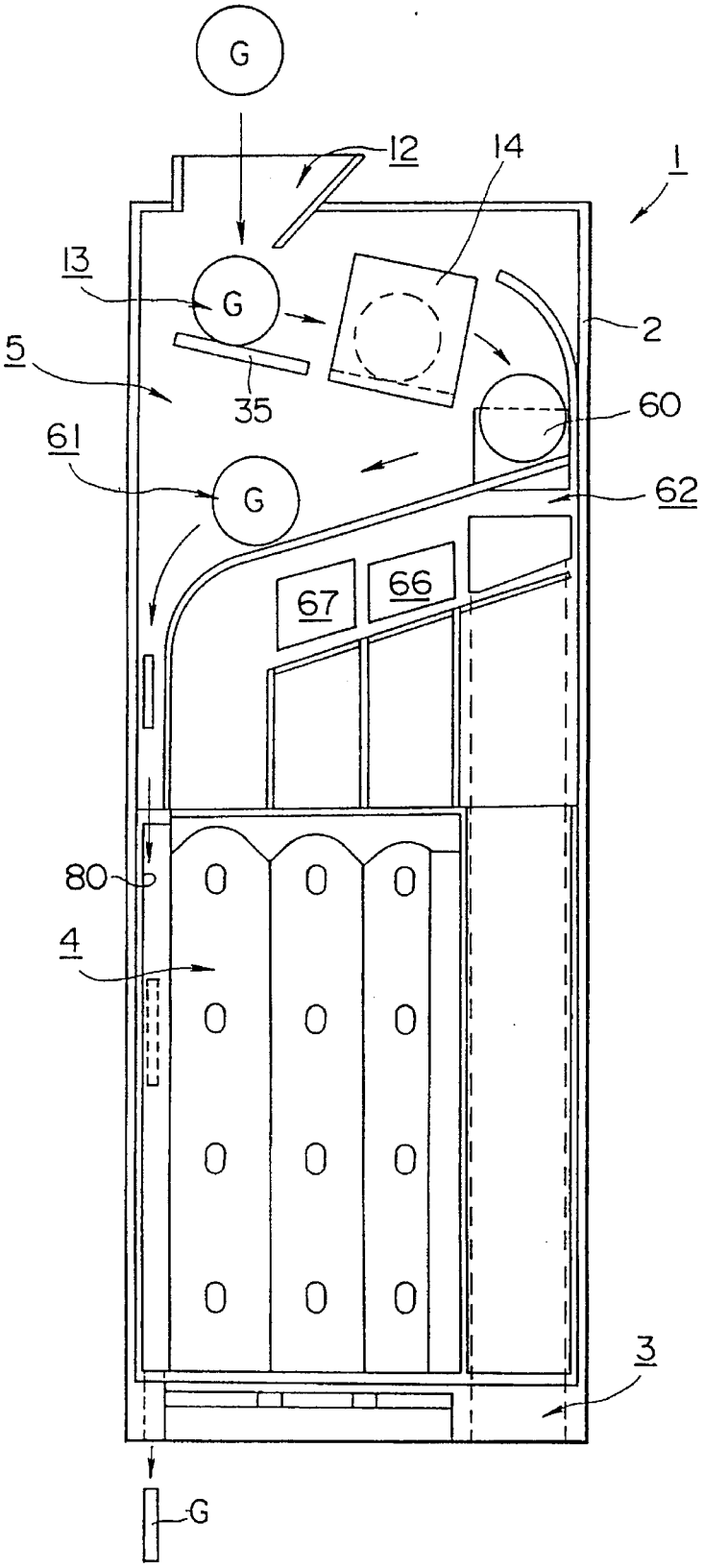
FIG. 10 is a conceptual view of a coin processing apparatus which illustrates the coin selective operation of the coin selecting unit.

In FIGS. 10 and 9, the same elements are identified with the same reference numerals. In FIG. 10, when the coin G put into the coin slot 12 is determined as a false one on the basis of a detection signal from the coil sensor 14, the first lever 60, in response to the detection signal, maintains its initial position at which the upstream portion of the second coin path 61 is opened and simultaneously, the upstream portion of the third coin path 62 is closed (i.e., the upper portion of the first lever 60 is initially closed). In response, the false coin G rolling in the first coin path 13 is guided by the first lever 60 into the second coin path 61 and further returned to the coin return outlet (not shown) through a false coin discharge shoot 80 formed on the left side of the housing 2 of the coin processing apparatus.

Figure 11:
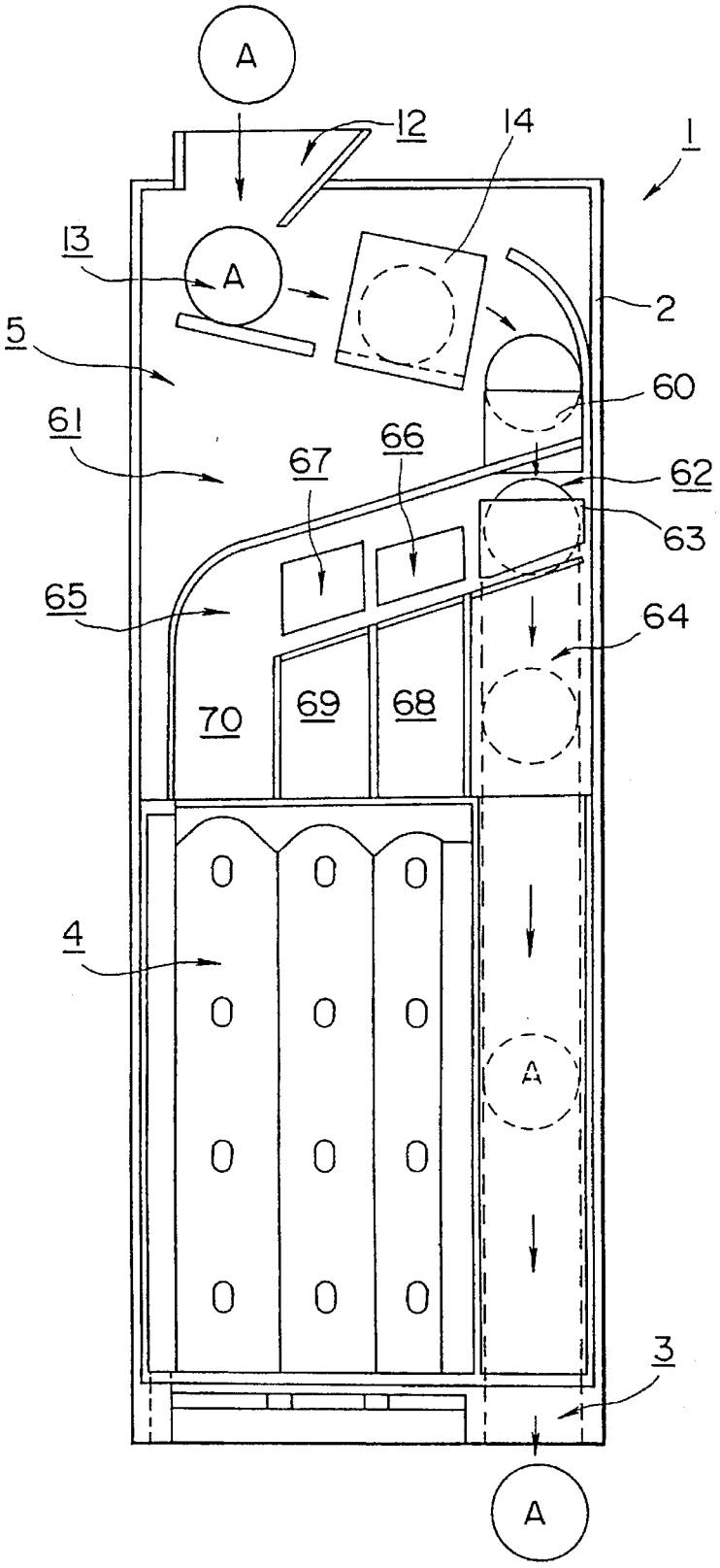
FIG. 11 is a conceptual view of a coin processing apparatus which illustrates the coin selective operation of the coin selecting unit.

In FIGS. 11 and 9, the same elements are identified with the same reference numerals. In FIG. 11, when a coin is put into the coin slot 12 and determined as the coin A on the basis of a detection signal from the coil sensor 14, the first lever 60 is actuated (i.e., the upper end of the first lever 60 is opened for the predetermined angle) on the basis of the detection signal so as to close the upstream portion of the second coin path 61 and simultaneously to open the upstream portion of the third coin path 62. The second lever 63, on the basis of the detection signal from the coil sensor 14, maintains its initial position at which the upstream portion of the fifth coin path 65 is closed and the upstream portion of the fourth coin path 64 is opened (i.e., the upper portion of the second lever 63 is initially opened for the predetermined angle). The coin A rolling in the first coin path 13 is then guided by the first lever 60 into the third coin path 62, then into the fourth coin path 64 formed on the back side of the housing 2 by the second lever 63 and finally accommodated in a cash box (not shown).

Figure 12:
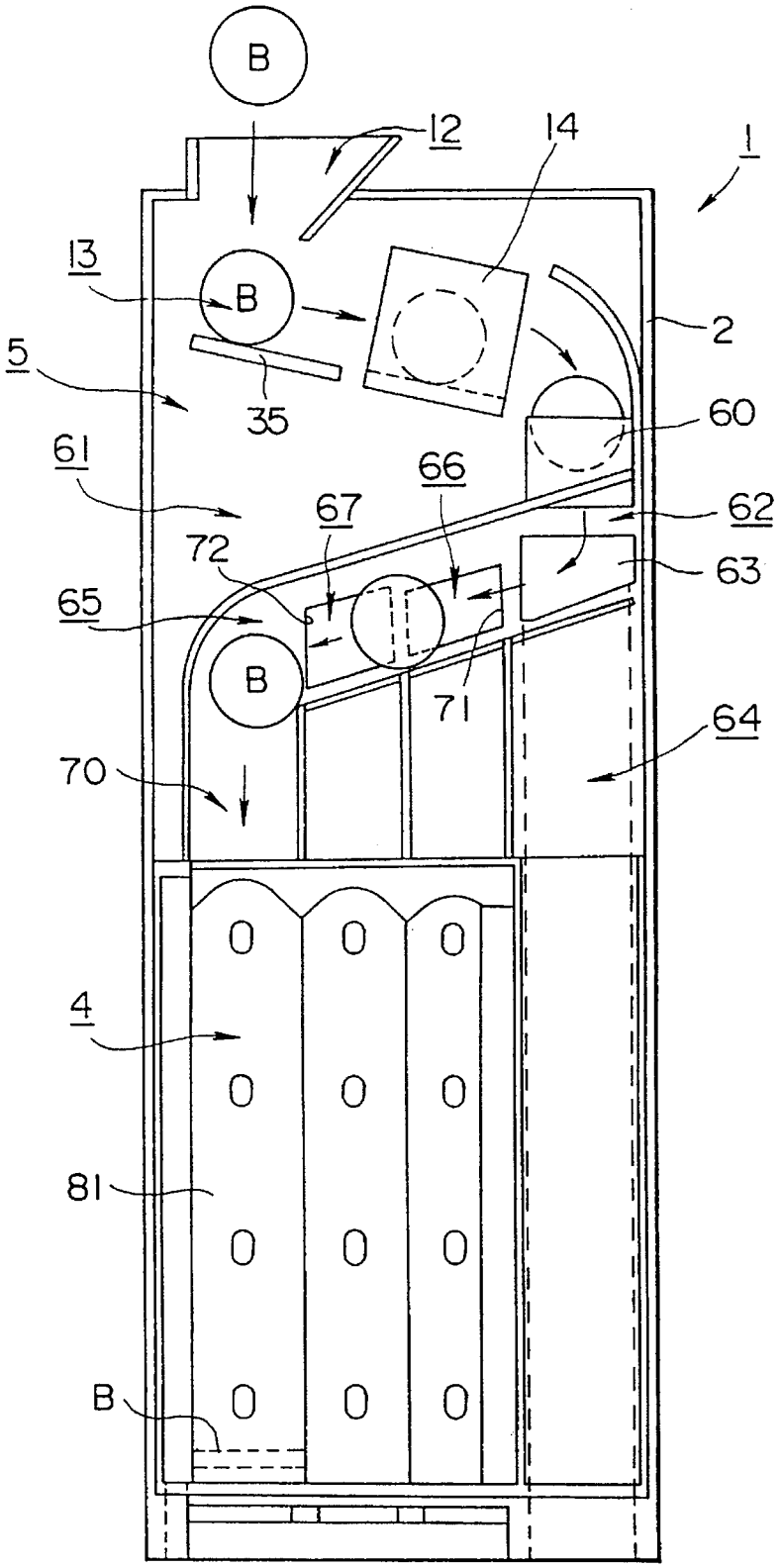
FIG. 12 is a conceptual view of a coin processing apparatus which illustrates the coin selective operation of the coin selecting unit.

In FIGS. 12 and 9, the same elements are identified with the same reference numerals. In FIG. 12, when a coin is put into the coin slot 12 and determined as the coin B on the basis of a detection signal from the coil sensor 14, the first lever 60 is actuated to opened on the basis of the detection signal so as to close the upstream portion of the second coin path 61 and simultaneously to open the upstream portion of the third coin path 62. The second lever 63 is also actuated (i.e., the second lever 63 being in its initial position is closed) on the basis of the detection signal from the coil sensor 14 so as to open the upstream portion of the fifth coin path 65 and to close the upstream portion of the fourth coin path 64. The coin B rolling in the first coin path 13 is then guided by the first lever 60 into the third coin path 62, and then into the fifth coin path 65 by the second lever 63. The coin B then passes by the windows 71 and 72 which constitute the first and second rail type coin selection means 66 and 67, respectively, falls within the eighth coin path 70 formed at the end of the fifth coin path 65 and is stored in the coin tube 81 of the coin accommodating unit 4 disposed at the lower end of the eighth coin path 70.

Figure 13:
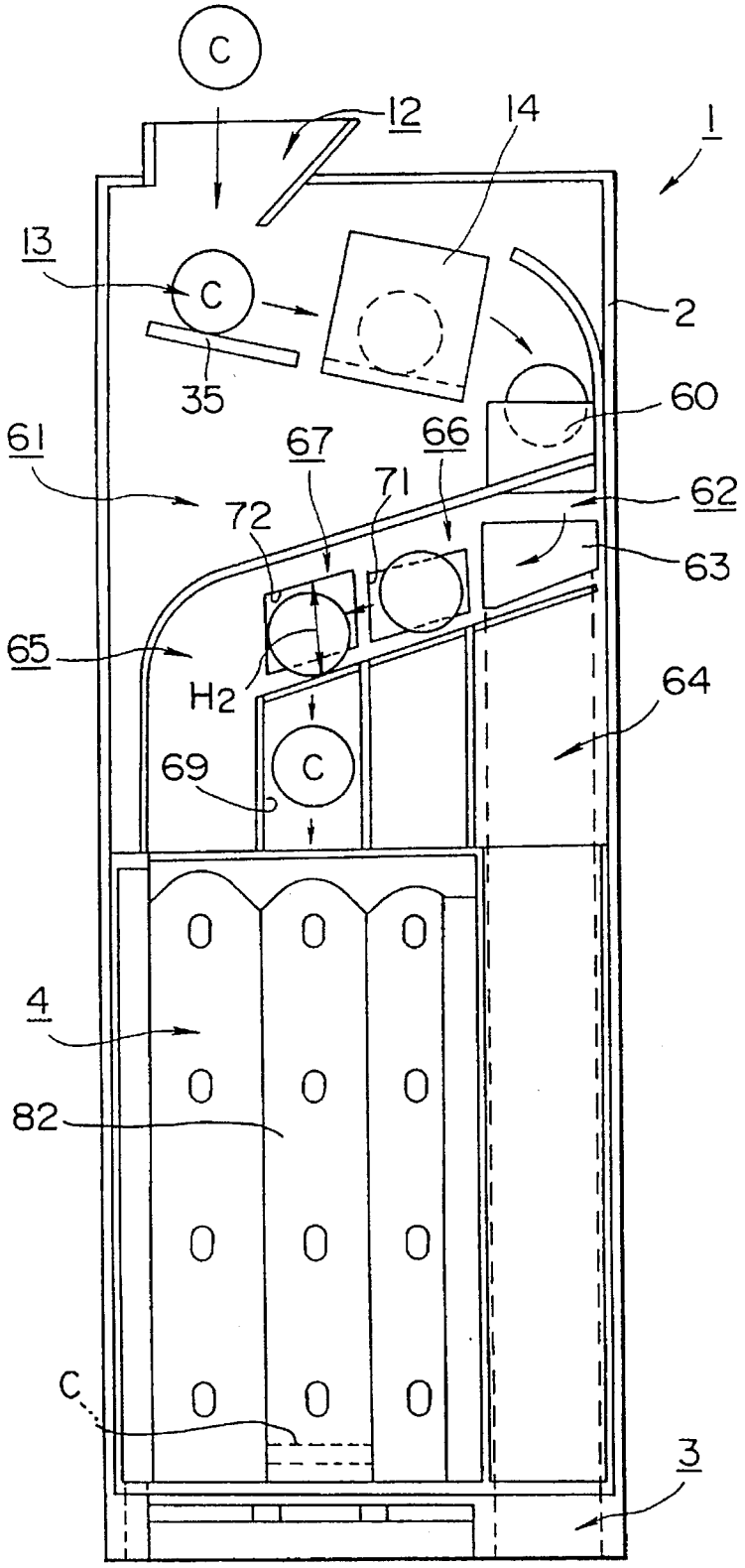
FIG. 13 is a conceptual view of a coin processing apparatus which illustrates the coin selective operation of the coin selecting unit.

In FIGS. 13 and 9, the same elements are identified with the same reference numerals. In FIG. 13, when a coin is put into the coin slot 12 and determined as the coin C on the basis of a detection signal from the coil sensor 14, the first lever 60 is actuated to open on the basis of the detection signal so as to close the upstream portion of second coin path 61 and simultaneously to open the upstream portion of the third coin path 62. The second lever 63 is also actuated to close on the basis of the detection signal from the coil sensor 14 so as to open the upstream portion of the fifth coin path 65 and to close the upstream portion of the fourth coin path 64. The coin C rolling in the first coin path 13 is then guided by the first lever 60 into the third coin path 62, and then into the fifth coin path 65 by the second lever 63. The coin C then passes by the window 71 which constitutes the first rail-type coin selection means 66, tilts into the window 72 which constitutes the second rail-type coin selection means 67 since the coin C is smaller in diameter than the height H2 of the window 72, while changing its posture, falls into the seventh coin path 69 formed below the window 72, and is stored in the coin tube 82 of the coin accommodating unit 4 disposed at the lower end of the seventh coin path 69.

Figure 14:
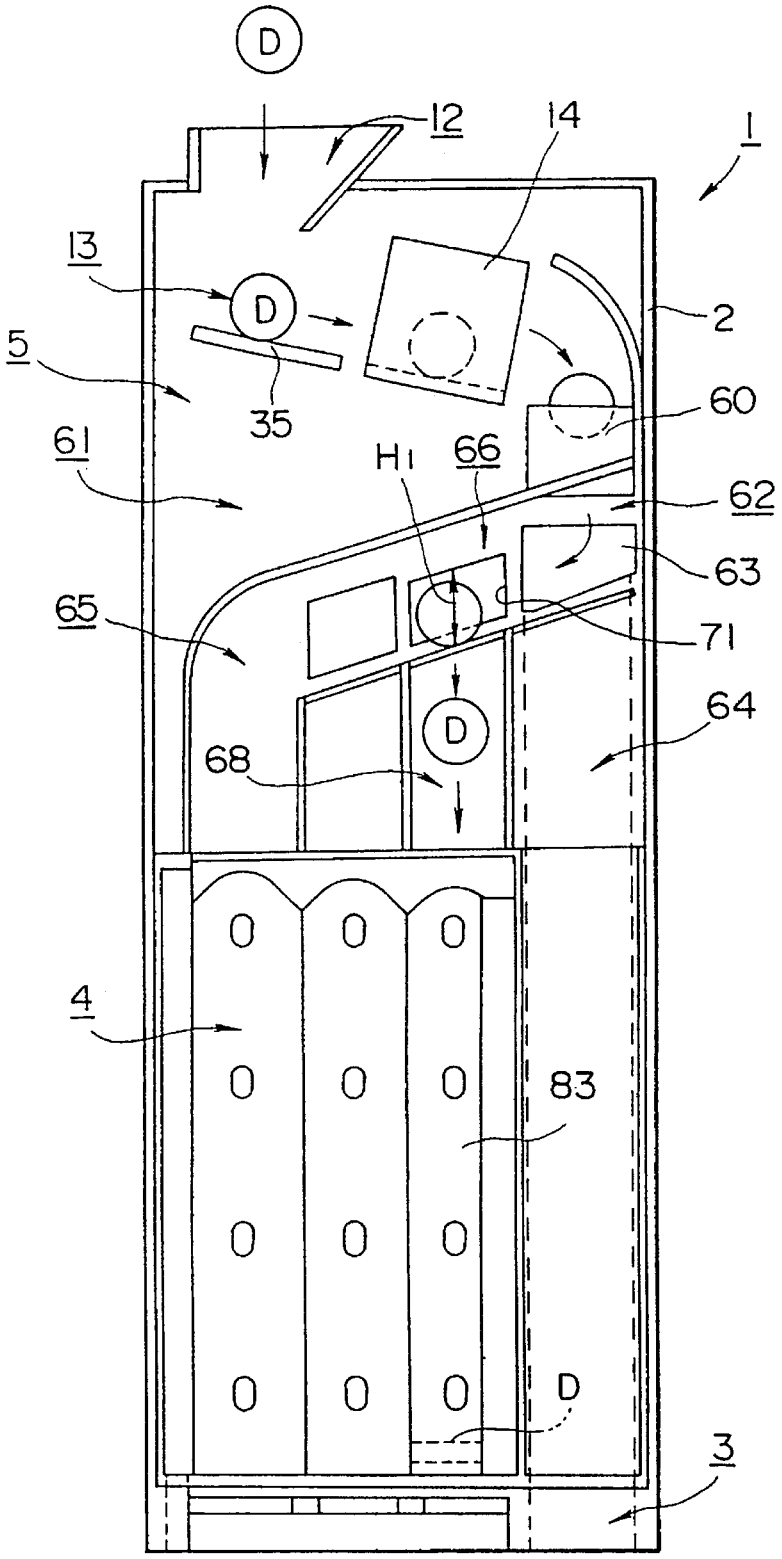
FIG. 14 is a conceptual view of a coin processing apparatus which illustrates the coin selective operation of the coin selecting unit.

In FIGS. 14 and 9, the same elements are identified with the same reference numerals. In FIG. 14, when a coin is put into the coin slot 12 and determined as the coin D on the basis of a detection signal from the coil sensor 14, the first lever 60 is actuated to open on the basis of the detection signal so as to close the upstream portion of the second coin path 61 and simultaneously to open the upstream portion of the third coin path 62. The second lever 63 is also actuated to close on the basis of the detection signal from the coil sensor 14 so as to open the upstream portion of the fifth coin path 65 and to close the upstream portion of the fourth coin path 64. The coin D rolling in the first coin path 13 is then guided by the first lever 60 into the third coin path 62, and then into the fifth coin path 65 by the second lever 63. When the coin D enters the first rail type coin selection means 66, it tilts into the window 71 since the coin D is smaller in diameter than the height H1 of the window 71, while changing its posture, falls into the sixth coin path 68 formed below the window 71, and is stored in the coin tube 83 of the coin accommodating unit 4 disposed at the lower end of the sixth coin path 68.

While in the above embodiments the genuine coins are illustrated as four kinds of coins A, B, C and D only different in diameter, the coin A is preferably a coin of the maximum denomination among the usable genuine coins since the coin A is accommodated through the fourth coin path 64 into the cash box (not shown).

The respective coins B, C and D selected by the coin selecting unit 5, piled and accommodated in the respective coin tubes 81, 82 and 83 of the coin accommodating unit 4 are paid out as change by a well-known payment unit constituting the coin payment unit 3 such as, for example, a pay-out slider or a pay-out plunger from the lower end of the housing 2 to the coin return outlet (not shown).

As described above, according to the coin processing apparatus of the present invention, since the coin selecting unit, the coin accommodating unit and the coin payment unit are inseparably disposed as an integrated unit within the single housing, housings for respectively accommodating the coin selecting unit and the coin accommodating unit as independent parts and various members such as engaging members for detachably attaching the respective housings to the coin payment unit which constitutes the main body of the apparatus are not required. Thus, not only the structure of the apparatus is simplified but also the parts of the apparatus are reduced in number whereby a cheeper coin processing apparatus can be provided. Further, since the liquid guide grooves are formed at the coin slot to rapidly discharge poured liquid to the outside of the coin processing apparatus, even if adhesive liquid such as cleaning detergent is poured into the coin slot, it does not adhere to the various elements disposed within the coin selecting unit. Therefore, the coin processing apparatus can be effectively protected from wicked mischief such as pouring in liquid and thus the deterioration in the functions of the coin processing apparatus can be prevented.

The present invention is practicable in various forms without departing from the spirit or main features of the present invention. Therefore, the above embodiments should be described only for illustrative purposes and should not be restrictedly construed. The-scope of the present invention is shown only by the attached claims and should not be bound by the specification text. Changes and modifications within the equivalent scope of the claims are contemplated as falling within the scope of the invention.

What is claimed is:

1. A coin processing apparatus comprising:

a single-piece housing (2) having a coin accommodating section (4) disposed at a middle portion of the housing (2), the coin accommodating section (4) including a plurality of coin tubes for accommodating coins according to denominations of the coins, and a coin pay-out section (3) disposed at a lower portion of the housing (2) for paying out coins from the coin accommodating section (4) in accordance with an amount of change;

a coin slot (12) for receiving the coins, one side of the coin slot (12) being formed at an upper portion of the housing (2);

a slanted guide groove (20) formed at a position immediately below the coin slot (12) for downwardly guiding liquid poured into the coin slot (12), one side of the groove (20) being formed by an inside upper surface of the upper portion of the housing (2);

a liquid collecting section (50) disposed below the groove (20), for collecting the liquid falling along the groove (20), one side of the liquid collecting section (50) being formed by said inside upper surface of the upper portion of the housing (2);

a liquid discharge path (52, 53) including a hole (52) formed on a side of the liquid collecting section (50) and a tube (53) communicating with the hole (52), for discharging the liquid collected in the liquid collecting section (50) to the outside of the housing (2), the tube (53) being located at the upper portion of the housing (2);

a coin selecting section (14) for discriminating whether the coins inserted from the coin slot (12) are genuine or not and denominations of coins determined as genuine, one side of the coin selecting section (14) being formed by the inside upper surface of the upper portion of the housing (2);

a coin distributing section (66, 67) for distributing the coins according to the denominations which are determined as genuine by the coin selecting section (14), one side of the coin distributing section (66, 67) being formed by the upper inside surface of the upper portion of the housing (2);

a coin path (63) for guiding the coins determined as genuine by the coin selecting section (14) to the coin distributing section (66, 67), one side of the coin path (63) being formed the upper inside surface of the upper portion the housing (2); and a coin path (68, 69, 70) for guiding a plurality of kinds of coins distributed according to the denominations by the coin distributing section (66, 67) to each corresponding one of the coin tubes of the coin accommodating section (4), one side of the coin path (68, 69, 70) being formed at the upper portion of the housing (2).

2. A coin processing apparatus according to claim 1, wherein the guide groove (20) comprises a plurality of slanted fins (21) and a plurality of dams (22) provided at a predetermined pitch between adjacent fins (21) for temporarily stopping a flow of liquid.

3. A coin processing apparatus according to claim 2, wherein the dams (22) are vertically and downwardly extended.

4. A coin processing apparatus according to claim 1, wherein the liquid collector (50) comprises a box (51) open at an upper end thereof.

5. A coin processing apparatus according to claim 1, further comprising a tube (54) provided at a side of the housing (2) for discharging the liquid, the tube communicating an upper end thereof with a downstream end of the tube (53).

* * * * *